US005494422A

United States Patent [19]

Ukai et al.

[11] Patent Number: 5,494,422

[45] Date of Patent: Feb. 27, 1996

[54] SCROLL TYPE COMPRESSOR HAVING A DISCHARGE VALVE RETAINER WITH A BACK PRESSURE PORT

[75] Inventors: Tetuzou Ukai; Kimiharu Takeda; Kazuhiro Sato, all of Aichi, Japan

[73] Assignee: Mitsubishi Jukogyo Kabushiki Kaisha, Tokyo, Japan

[21] Appl. No.: 216,317

[22] Filed: Mar. 23, 1994

[30] Foreign Application Priority Data

Sep. 3, 1993 [JP] Japan ..... 5-219588

[51] Int. Cl.[6] ..... F01C 1/04; F04C 18/04

[52] U.S. Cl. ..... 418/55.1; 418/55.2; 418/55.4; 418/270; 418/55.6

[58] Field of Search ..... 418/55.1, 55.6, 418/270, 55.2, 55.4, 55.5, 57

[56] References Cited

U.S. PATENT DOCUMENTS

| | | | |
|---|---|---|---|
| 4,438,936 | 3/1984 | Schlegel | 277/212 C |
| 4,580,790 | 4/1986 | Doose | 277/228 |
| 5,192,202 | 3/1993 | Lee | 418/57 |
| 5,257,920 | 11/1993 | Takeda | 418/55.1 |
| 5,395,224 | 3/1995 | Caillat et al. | 418/55.6 |

FOREIGN PATENT DOCUMENTS

| | | | |
|---|---|---|---|
| 1130082 | 5/1989 | Japan | 418/55.1 |
| 5149269 | 6/1993 | Japan | 418/55.1 |
| 5-157063 | 6/1993 | Japan | 418/55.5 |

*Primary Examiner*—John J. Vrablik
*Attorney, Agent, or Firm*—Jacobson, Price, Holman & Stern

[57] ABSTRACT

A scroll type compressor includes a check valve (42) having a valve element (63) disposed in a valve chamber (36, 60) and moveable in the vertical direction. A back pressure port (60*a*) having one end opening at a retainer surface (62*a*) and the other end communicating with a high-pressure side chamber (3, 43) is disposed in a retainer having the retainer surface thereon which is engaged by the valve element (63) when the check valve is in the open position.

7 Claims, 7 Drawing Sheets

SCROLL TYPE COMPRESSOR HAVING A DISCHARGE VALVE RETAINER WITH A BACK PRESSURE PORT

This application relates to application Ser. No. 08/223,782, filed Apr. 6, 1994, entitled SCROLL-TYPE FLUID MACHINE HAVING A SEALED BACK PRESSURE CHAMBER in the names of Takeda et al.

BACKGROUND OF THE INVENTION

The present invention relates to a scroll type compressor including a check valve disposed in a discharge port for communicating a scroll type compression mechanism with a discharge chamber.

Recently, in an air-conditioning system (refrigerating cycle), a scroll type compressor is adopted since it can perform compression efficiently.

As shown in FIGS. 8 and 9, the scroll type compressor comprises a scroll type compressor unit h (compression mechanism) having a combination of a stationary scroll d including an end plate a, a spiral wrap b and a peripheral wall c disposed to surround the spiral wrap b and a revolving scroll g including an end plate e and a spiral wrap f disposed upright on the end plate e.

More particularly, the compressor unit h is configured to form an airtight space i for performing a compression process between the wraps b and f by combining both the scrolls d and g so that the wraps b and f are shifted with respect to each other by a predetermined angle and are engaged with each other.

The revolving scroll g is revolved by means of a rotating shaft m having an eccentric pin k formed at an end thereof, for example, so that the airtight space i is varied by the revolution.

That is, when the revolving scroll g is revolved around an axis of the stationary scroll d by means of the rotating shaft m, a capacity of the airtight space i is reduced gradually toward the central portion from the peripheral portion of the compressor unit h, so that variation of the capacity of the airtight space i is utilized to compress gas. Although not shown, the revolving scroll g is provided with a rotation checking mechanism such as an Oldham's coupling for checking rotation of the revolving scroll g on its axis.

The scroll type compressor usually utilizes a chamber to reduce surging of discharge gas and the gas is then discharged to the outside.

More particularly, as shown in FIG. 8, formed above the compressor unit h is a discharge chamber x constituted by members such as an airtight housing v and a discharge cover w. The discharge chamber x communicates with the compressor unit h through a discharge port n. Further, the discharge chamber x also communicates with a discharge pipe y mounted to the airtight housing v.

The discharge gas compressed by the compressor unit h is introduced into the discharge chamber x in which surging of the discharge gas is reduced, and then the gas is discharged from the discharge pipe y to the outside of the compressor.

The compressor unit h is provided with a check valve o disposed in the discharge port n in order to prevent backflow of the discharge gas.

A so-called free-type check valve is used as the check valve o since its structure is very simple.

More particularly, the free-type check valve o includes a valve chest p formed on the way of the discharge port n, a valve seat q formed on a peripheral edge of an opening of a discharge port $n_1$ in the valve chest p, a retainer r formed in a wall surface opposite to the opening the discharge port $n_1$, and a valve element s disposed between the valve seat q and the retainer r movably.

The discharge port $n_1$ positioned upstream of the check valve o divided by the valve chest p extends from the valve seat q to the compressor unit h and discharge ports $n_2$ positioned downstream extend from peripheral sides of the valve chest p to the discharge chamber x.

Accordingly, when the compressor unit h is operated, the valve element s of the check valve o is displaced to the side of the retainer r in response to pressure of the discharge gas to abut against the retainer, so that the discharge port n is opened.

When the operation of the compressor unit h is stopped, pressure in the compressor unit h is reduced and accordingly the valve element s of the check valve o is moved to the side of the valve seat q to abut against the surface of the valve seat, so that the discharge port n is closed. The operation of the check valve o suppresses the backflow of the discharge gas from the discharge chamber x to the compressor unit h when the operation of the compressor is stopped, so that reverse rotation of the compressor due to the backflow is prevented.

The valve element s is attached to the retainer by means of adhesive force of oil contained in the compressor during operation of the compressor. Accordingly, even when the compressor is stopped, the valve element s is not separated from the retainer easily due to adhesive force of oil between the valve element s and the retainer r depending on the operation conditions of the compressor, so that there is a possibility that the valve element s closes the discharge port late, that is, delayed closing occurs. When the delayed closing occurs, the discharge gas flows back to the compressor unit h through the discharge port n until the valve element closes the discharge port, so that the compressor unit h is disadvantageously caused to be reversely rotated while generating large sound.

BRIEF SUMMARY OF THE INVENTION

The object of the present invention is to overcome the above problems by providing a scroll type compressor capable of ensuring stable operation of a check valve.

In order to achieve the object, the scroll type compressor according to a first aspect of the present invention comprises a back pressure port disposed in a retainer and having one end opening at a retainer surface against which a valve element abuts and the other end communicating with a high-pressure side chamber.

According to the first aspect of the present invention, when operation of a compression mechanism is stopped, discharge pressure in a discharge chamber is added to the back of the valve element of the check valve attached to the retainer surface. Force for separating the valve element of the check valve is increased proportionally to the back pressure. Accordingly, the valve element is separated from the retainer surface immediately and reaches the valve seat to close the discharge port.

Thus, the check valve is closed immediately regardless of operation conditions of the compression mechanism when operation of the compression mechanism is stopped. Accordingly, the delayed closing of the check valve causing the reverse rotation of the compressor unit is improved.

The scroll type compressor according to a second aspect of the present invention comprises a recess formed in the retainer surface in order to reduce the adhesive area or contact area of oil between the valve element and the retainer.

According to the second aspect of the present invention, since the adhesive area between the valve element and the retainer is reduced, the check valve is closed more stably.

In the scroll type compressor according to a third aspect of the present invention, in order to reduce the adhesive area of oil effectively, the recess comprises a stepped hole having a diameter smaller than an external diameter of the valve element and opening at the retainer surface substantially concentrically to the back pressure port.

According to the third aspect of the present invention, the adhesive area between the valve element and the retainer can be reduced effectively with a simple structure.

In the scroll type compressor according to a fourth aspect of the present invention, in order to reduce the adhesive area of oil effectively, the recess comprises a tapered hole having a diameter smaller than the external diameter of the valve element and opening at the retainer surface substantially concentrically to the back pressure port.

According to the fourth aspect of the present invention, the adhesive area between the valve element and the retainer can be reduced effectively with a simple structure.

In the scroll type compressor according to a fifth aspect of the present invention, in order to exert the back pressure on the valve element from the discharge port to separate the valve element from the retainer surface, an inlet of a downstream discharge port of the discharge port communicating with the high-pressure side chamber opens at the retainer surface.

In the scroll type compressor according to a sixth aspect of the present invention, the downstream discharge port also functions to exert the back pressure on the valve element to separate the valve element attached to the retainer surface. Accordingly, the delayed closing of the check valve is further improved proportionally to the increased area to which the back pressure is added.

BRIEF DESCRIPTION OF THE DRAWINGS

The invention will now be described in detail with reference to the accompanying drawings, wherein.

DETAILED DESCRIPTION OF THE PREFERRED EMBODIMENTS

The present invention is now described with reference to an embodiment illustrated in FIGS. 1 and 2.

Figure 1:
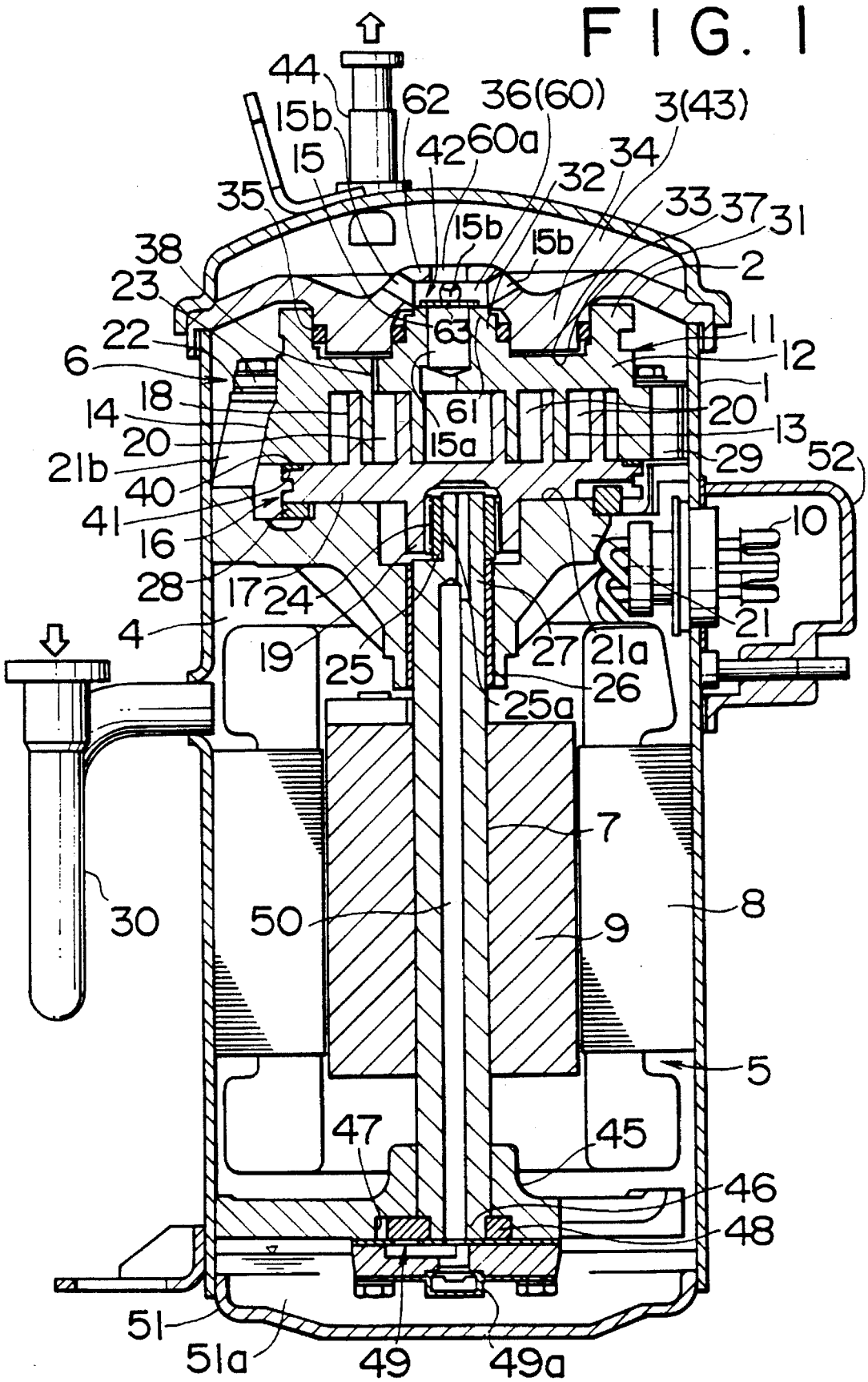
FIG. 1 is a cross-sectional view schematically illustrating a scroll type compressor according to a first embodiment of the present invention.
Figure 2:
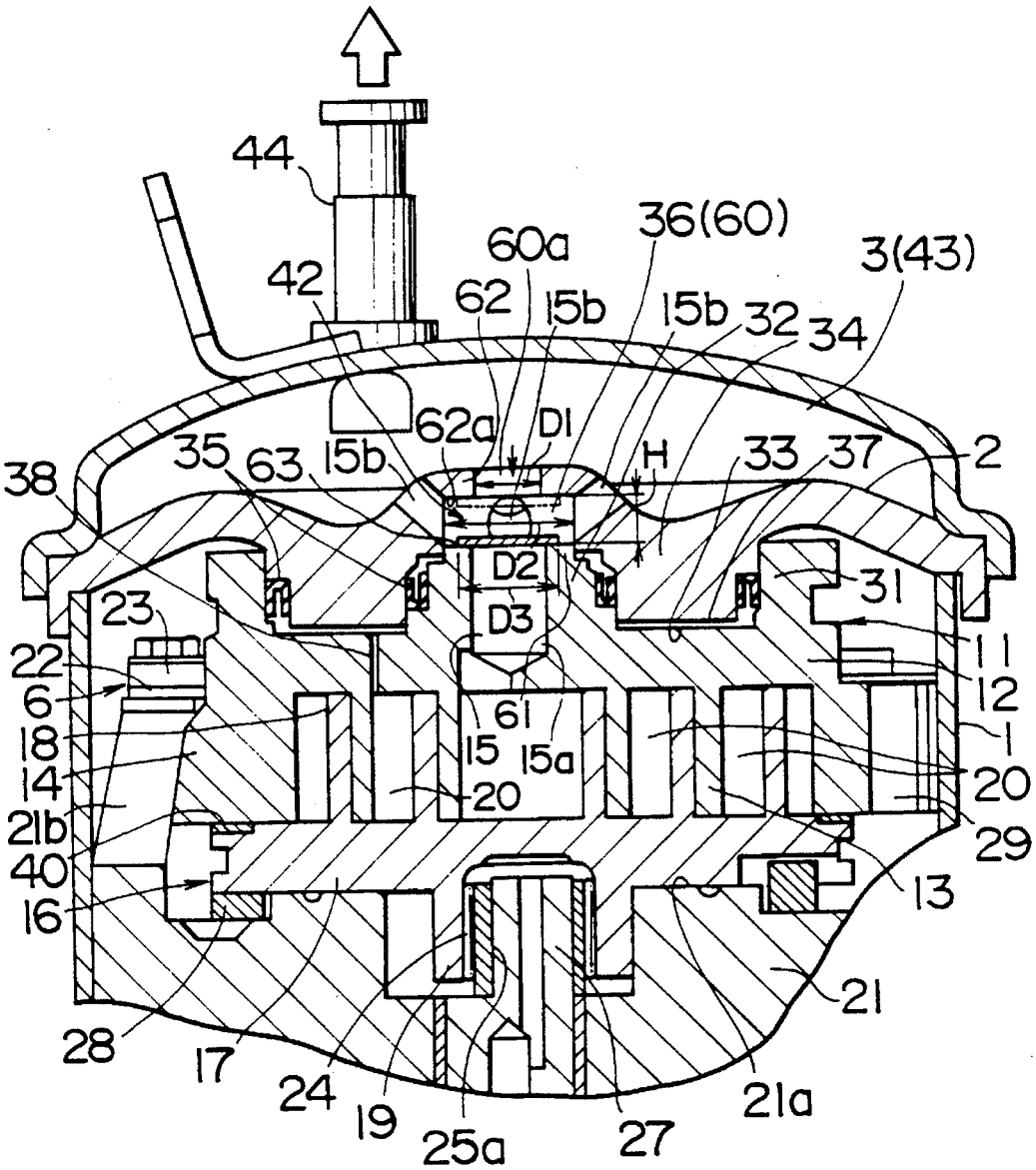
FIG. 2 is an enlarged cross-sectional view schematically illustrating a check valve and its periphery provided in a compressor unit of the embodiment of FIG. 1.

FIG. 1 illustrates a scroll type compressor to which the present invention is applied. In FIG. 1, numeral 1 denotes an airtight housing, which is formed into a cylindrical shape extending vertically.

A discharge cover 2 made of ferric material is disposed in an upper portion in the airtight housing 1 to divide the housing 1 into upper and lower portions. The upper portion of the housing constitutes a high-pressure side chamber 3 and the lower portion constitutes a low-pressure side chamber 4.

A motor 5 is disposed in a lower portion of the low-pressure side chamber 4 of the housing 1 and a scroll type compressor unit 6 (compression mechanism), for example, is disposed in an upper portion of the low-pressure side chamber 4. A rotating shaft 7 is disposed between the motor 5 and the compressor unit 6.

The motor 5 includes a stator 8 which is press fitted into an inner periphery of the housing 1 to be supported therein and a rotor 9 disposed within the stator 8. The rotor 9 is fixedly mounted in a lower portion of the rotating shaft 7 to produce rotation from the rotating shaft 7. A terminal 10 connected to the stator 8 is disposed in an outer periphery of the housing 1.

The scroll type compressor unit 6 includes a stationary scroll 11 made of aluminum as a whole and a revolving scroll 16 made of aluminum and combined with the stationary scroll 11.

More particularly, the stationary scroll 11 includes an end plate 12, a spiral wrap (identical with the wrap b shown in FIG. 9) mounted upright on an internal surface of the end plate 12, and a peripheral wall 14 disposed upright on the internal surface of the end plate to surround the wrap 13. A discharge port 15 is provided in the central portion of the end plate 12.

The revolving scroll 16 includes an end plate 17 and a spiral wrap 18 (identical with the wrap f shown in FIG. 9) mounted upright on the an internal surface of the end plate 17. A cylindrical boss 19 is formed in the middle of an external surface of the end plate 17.

Figure 9:
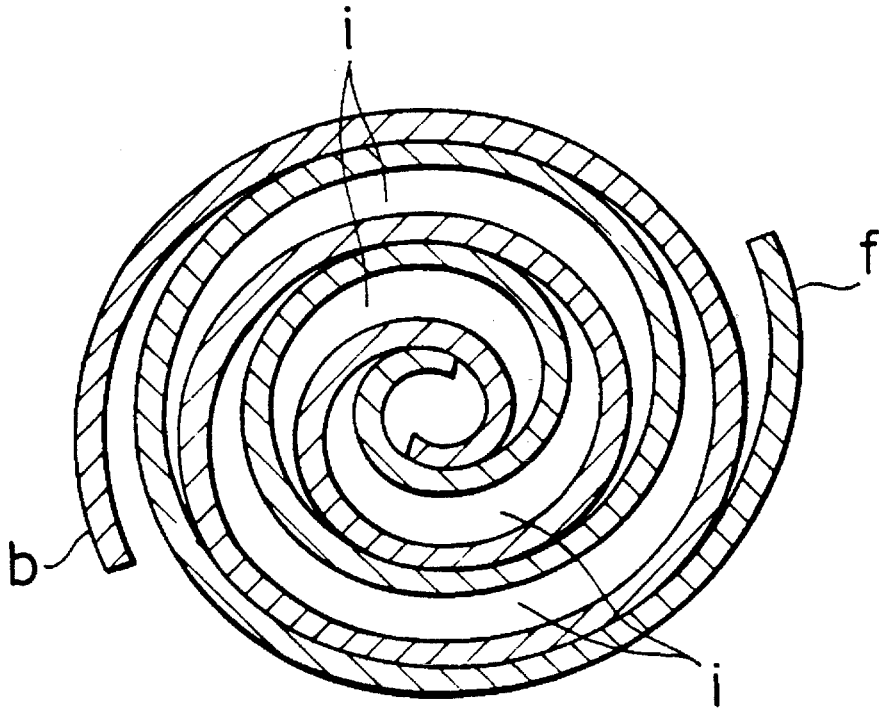
FIG. 9 PRIOR ART
FIG. 9 is a cross-sectional view schematically illustrating wraps of a stationary scroll and a revolving scroll of a scroll type compressor engaged with each other.

The stationary scroll 11 and the revolving scroll 16 are combined to come into contact with each other while being shifted from each other with 180 degrees (predetermined angle) so that a plurality of airtight crescent spaces 20 for effecting the compression process are formed by the end plates and the wraps (identical with the airtight spaces i shown in FIG. 9).

The combined scrolls 11 and 16 are disposed between the discharge cover 2 and a main frame 21 in the form of a casing fixedly mounted in the upper portion of the low-pressure side chamber 4 so that the stationary scroll 11 is disposed on an upper side thereof and the revolving scroll 16 is disposed on the lower side.

The end plate 12 of the revolving scroll 16 is slidably engaged with a horizontal receiving plane **21*a* formed on an upper surface of the main frame 21**.

The stationary scroll 11 is supported displaceablly in the vertical direction by means of a supporting spring 22 such as a coil spring, a coned disc spring or the like with respect to a peripheral wall portion 21*b* formed on an outer peripheral side of the main frame 21. More particularly, a bracket 23 protruding toward the side of the peripheral wall portion 21*b* is disposed in the stationary scroll 11. The bracket 23 is fixedly mounted through the supporting spring 22 on the peripheral wall portion 21*b*.

A suction port (not shown) formed in the peripheral wall 14 of the stationary scroll 11 communicates with a suction pipe 30 connected to the outer periphery of the housing 1, through a space 29 on the side of the peripheral wall 14, a suction path (not shown) disposed in the main frame 21 for communicating both sides of the main frame 21 with each other and the low-pressure side chamber 4 so that gas is introduced from the outside of the housing 1 to the compressor unit 6.

A drive bushing 25 is disposed in the boss 19 of the revolving scroll 16 through a rotation bearing 24. A slide hole 25*a* is formed in the drive bushing 25.

An upper end of the rotating shaft 7 penetrates the main frame 21 and extends toward the center of the end plate of the revolving scroll 16. The upper end of the rotating shaft 7 is rotatably supported by an upper bearing 26 disposed in the penetration portion of the main frame 21. An eccentric pin 27 is disposed on the upper end of the rotating shaft 7. The eccentric pin 27 is slidably fitted into the slide hole 25. Thus, the revolving scroll 16 is revolved around the axis of the stationary scroll 11 when the rotating shaft 7 is rotated.

Disposed between the end plate 17 of the revolving scroll 16 and the receiving plane 21*a* of the main frame 21 is a rotation checking mechanism such as, for example, an Oldham's coupling 28 which allows revolution of the rotating scroll 16 but checks rotation of the revolving scroll 16 on its axis.

The capacity of the airtight spaces 20 is gradually reduced by the revolution of the revolving scroll 16 obtained by the Oldham's coupling 28 and the eccentric pin 27. That is, the airtight spaces are utilized to compress gas therein.

Two cylindrical large and small flanges 31 and 32 formed around the axis of the end plate 12 pretrude upwardly from an upper surface of the end plate 12 of the stationary scroll 11.

A cylindrical flange 34 is formed on an inner surface of the discharge cover 2 and protrudes downwardly into a cylindrical recess 33 formed between the flanges 31 and 32. The flange 34 is slidably fitted in the recess 33. That is, the flange 34 is slidably engaged with the flanges 31 and 32.

Annular inner and outer U-cup packings 35 are interposed between the sides of the flanges 34, 31 and 32 which slidingly abut against each other to seal them.

Thus, a high-pressure chamber 36 is formed in a central area partitioned by the inner U-cup packing 35, that is, in a central portion on the upper surface of the end plate 12 covered by the central portion of the discharge cover 2, and a medium-pressure chamber 37 is formed in recess 33 in an intermediate area partitioned by the inner and outer U-cup packings 35 on the side of the outer periphery, that is, in the intermediate portion on the upper surface of the end plate 12 covered by facing surface portion of the flange 34 on discharge cover 2. Further, a low-pressure chamber having the same pressure as the suction pressure is formed on the outer peripheral side of the medium pressure chamber by the space 29.

The high-pressure chamber 36, of the concentrically arranged high-, medium- and low-pressure chambers, communicates with the compressor unit 6 through an upstream discharge port 15*a* constituting a part of discharge port 15. The medium-pressure chamber 37 communicates with the airtight spaces 20 being on the way of compression through an pressure introduction hole 38 formed in the end plate 12. The stationary scroll 11 floating up is pressed to the revolving scroll 16 in the axial direction by high pressure and medium pressure gas introduced in the high-pressure chamber 36 and the medium-pressure chamber 37 which are sealed by the U-cup packings 35.

Further, a hard wearproof plate 40 in the form of a ring is disposed in a peripheral edge of the peripheral wall 14 of the stationary scroll 11 slidingly abutting against the axial end surface of the revolving scroll 16. The wearproof plate 40 suppresses wear caused by force occurring during operation for reversely rotating the revolving scroll 16.

A plurality of downstream discharge ports 15*b* constituting other parts of the discharge port 15 are formed in the discharge cover 2. The discharge ports 15*b* communicate the high-pressure chamber 36 with a discharge chamber 43.

A check valve 42 for prevention of backflow is disposed on the discharge port 15. A free-type check valve is used as the check valve 42. A structure in the vicinity of the check valve 42 is illustrated on FIG. 2 in an enlarged scale.

In the structure of the check valve 42, a valve chamber 60 is configured by high-pressure chamber 36. The valve chamber 60 is formed in an intermediate portion of the discharge port 15 into a cylindrical shape having a diameter larger than that of the upstream discharge port 15*a*. Upstream and downstream wall surfaces of the valve chamber 60 opposite to each other are utilized to form a valve seat 61 on a peripheral edge of an opening of the discharge port 15*a* and form a retainer 62 in a position opposite to the valve seat 61. A valve element 63 in the form of a round plate is disposed movably between the valve seat 61 and the retainer 62. That is, the valve element 63 is freely movable between the valve seat 61 and the retainer 62.

Further, a back pressure port 60*a* extending in the vertical direction is disposed in the retainer 62. A lower end of the back pressure port 60*a* opens at a retainer surface against which the valve element 62 abuts and an upper end of the port 60*a* communicates with the discharge chamber 43. Thus, pressure of discharge gas in the discharge chamber 43 is applied to the valve element 63 positioned at the retainer surface 62*a* as back pressure.

When the compressor unit 6 is operated, the valve element 63 is pushed up toward the retainer surface 62*a* by pressure of gas discharged from the compressor unit 6 to open the discharge port 15. Further, when the operation of the compressor unit 6 is stopped, the valve element 63 is pushed down toward the valve seat 61 by retreating force caused by stopping the operation of the compressor unit 6 and back pressure (pressure in the discharge chamber 43) is applied through the back pressure port 60*a* to close the discharge port 15.

In other words, the check valve 42 closes the upstream discharge port 15*a* and suppresses or prevents the discharge gas from flowing back from the upstream discharge port 15*a* to the compressor unit 6 when the operation of the compressor unit 6 is stopped.

In order to prevent the backflow of the discharge gas effectively, in the embodiment, a diameter of the back pressure port 60*a* is set to satisfy the following equation:

$$D_3<\{H+(D_1+D_2)/2\}^{1/2}$$

where $D_1$ is the diameter of the back pressure port, $D_2$ is the internal diameter of the valve chamber, 60, $D_3$ is the outer diameter of the valve element and H is the height of the valve chamber between the valve seat 61 and retainer surface 62*a*.

The discharge chamber 43 communicates with a discharge pipe 44 connected to the upper wall of the housing 1 and is adapted to be able to discharge the gas discharged in the discharge chamber 43 to the outside of the housing 1.

On the other hand, the lower end of the rotating shaft 7 extends to an inner bottom of the housing 1. The lower end of the rotating shaft is rotatably supported by a lower bearing 45 mounted in a lower portion of the low-pressure side chamber 4.

Mounted in the lower end portion of the rotating shaft 7 is an oil pump (vane pump etc.) 49 adopting a pressuring mechanism which effects pumping operation, for example, by rotating an eccentric axis 46 to swing a revolving ring 48 accommodated in a cylinder 47. A suction portion (not shown) of the oil pump 49 communicates with an oil pan 51 formed in the inner bottom of the airtight housing 1 and sucks oil 51*a* accumulated in the oil pan 51. The suction portion of the oil pump 49 communicates with each of sliding portions of the compressor unit 6 through an oil path 50 formed in the rotating shaft 7 and can feed oil 51*a* in the oil pan 51 to portions requiring lubrication.

Disposed in the discharge portion of the oil pump 49 is a relief valve 49*a* for returning oil 51*a* into the oil pan 51 when a predetermined pressure is exceeded.

Numeral 52 denotes a terminal cover for covering the terminal 10 exposed to the outside of the housing 1.

Operation of the scroll type compressor constructed above is now described.

When the motor 5 is energized, the rotor 9 is rotated. This rotation is transmitted through the rotating shaft 7 to the oil pump 49.

The eccentric pin 46 of the oil pump 49 is rotated eccentrically to rotate the revolving ring 48.

Thus, oil 51*a* in the oil pan 51 is sucked from the suction portion of the oil pump 49 and is then discharged from the discharge portion. The discharged oil 51*a* is fed through the oil path 50 to various portions requiring the oil 51*a* such as lubrication portions of the compressor unit 6.

Further, the rotation of the motor 5 is also transmitted to the revolving scroll 16 through the rotating shaft 7, the eccentric pin 27 and the boss 19.

At this time, since the revolving scroll 16 is suppressed from being rotated on its axis by means of the Oldham's coupling 28, the whole revolving scroll 16 is not rotated on its axis and is revolved in a circular orbit having a revolution radius about the axis of the stationary scroll 11.

The airtight spaces 20 formed between the stationary scroll 11 and the revolving scroll 16 vary to reduce the capacity thereof with the revolution.

Thus, the sucked gas is led through the suction pipe 30, the low-pressure side chamber 4, the suction path and the suction port (both not shown) to the outermost peripheral area of the wraps 13 and 18 and is sucked from the area into the airtight spaces 20.

The sucked gas is compressed gradually as the capacity of the spaces 20 is reduced by the revolution of the revolving scroll 16, so that the compressed gas is moved to the central portion of the scroll type compressor unit to be discharged to the upstream discharge port 15*a*. At this time, the valve element 63 of the check valve 42 receives pressure of the discharge gas flowing in the discharge port 15*a* and is moved from the valve seat 61 indicated by solid line of FIG. 2 to the retainer surface 62*a* indicated by two-dot chain line of FIG. 2 to thereby open the discharge port 15*a*.

In this connection, pressure of the discharge gas is transmitted into the high-pressure chamber 36 (valve chamber 60) through the discharge port 15*a* and medium pressure on the way of compression is transmitted in the medium-pressure chamber 37 through the pressure introduction hole 38. Accordingly, the stationary scroll 11 is pressed on the revolving scroll 16 by the discharge pressure in the high-pressure chamber 36 and the medium pressure in the medium-pressure chamber 37. That is, the compression process in the spaces 20 is continuously made while preventing leakage of gas. Thus, the discharge gas in the valve chest 60 is discharged through the downstream discharge port 15*b* and the discharge chamber 43 from the discharge pipe 44 to the outside of the housing 1.

Thereafter, when the scroll type compressor is stopped, negative pressure caused by the stop of the compressor unit 6 acts on the upstream side 15*a* of the discharge port 15.

Further, positive pressure in the discharge chamber 43 acts on the back pressure port 60*a*. The positive pressure is exerted through the back pressure port 60*a* on the back surface of the valve element 63 of the check valve 42 attached to the retainer surface 62*a*. This means that the force for separating the valve element 63 from the retainer surface is not only the conventional negative pressure generated upon stopping of the compressor unit 6 but also the gas pressure (positive pressure) in the discharge chamber 43.

Consequently, a large force for separating the valve element 63 from the retainer surface 62*a* against the adhesive force of oil 51*a* acts on the valve element 63.

Thus, the valve element 63 which closes the discharge port late heretofore by the influence of the adhesive force of oil 51*a* is separated from the retainer surface 62*a* immediately and reaches the valve seat 61 to close the discharge port 15*a* by increase of the force for separating the valve element 63. The check valve is closed immediately regardless of operation situation of the compression mechanism when operation of the compressor mechanism is stopped.

Accordingly, the delayed closing of the check valve 42 causing the reverse rotation of the compressor unit 6 can be improved.

It has been confirmed from an experiment that the check valve 42 was operated stably in a wide area when the diameter of the back pressure port 60*a* was set in accordance with the above equation.

Accordingly, the reverse rotation caused by the delayed closing of the check valve 42 and occurrence of sound due to the reverse rotation can be prevented.

The present invention is not limited to the first embodiment and may be embodied as in second, third, fourth, fifth and sixth embodiments shown in FIGS. 3, 4, 5, 6 and 7, respectively.

Figure 3:
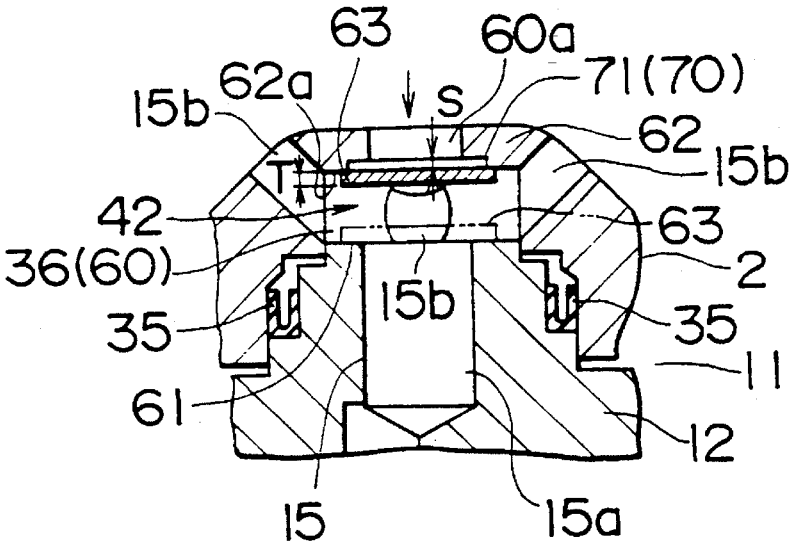
FIG. 3 is an enlarged cross-sectional view schematically illustrating a check valve and its periphery constituting a portion of a second embodiment of the present invention.

In the second embodiment shown in FIG. 3, a recess 70 is formed in the retainer surface 62*a* in addition to the back pressure port 60*a* to reduce a contact area (adhesive area) between the valve element 63 and the retainer surface 62*a*. More particularly, the recess 70 is formed by a stepped hole 71 having a diameter smaller than that of the valve element 63 and a depth S smaller than a thickness t of the valve element 63 and opening at the retainer surface 62*a* concentrically to the retainer surface 62*a*.

With the structure having the reduced contact area, since the adhesive force of oil 51*a* is reduced correspondingly, the check valve 42 can be closed more stably. Adoption of the stepped hole 71 has a merit that its structure is simple and the contact area between the valve element 63 and the retainer surface 62*a* can be reduced effectively.

Furthermore, since the depth S of the stepped hole 71, that is, a difference in level of the stepped hole 71 is smaller than the thickness t of the valve element 63, there is no possibility that the valve element 63 is caught in the back pressure port 60*a* and is not operated even if the valve element 63 moving between the valve seat 61 and the retainer 62 is inclined during the movement.

Figure 4:
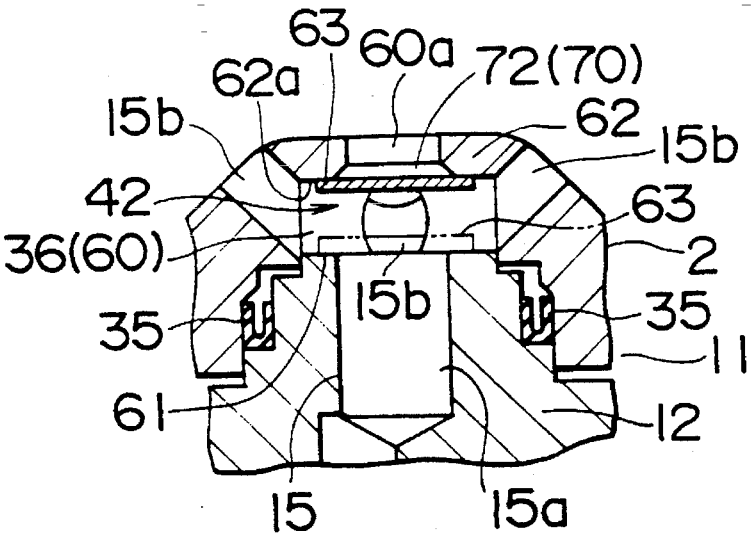
FIG. 4 is a view similar to FIG. 3 of a third embodiment of the present invention.

The third embodiment shown in FIG. 4 is a modification of the second embodiment. In the third embodiment, the recess 70 is formed by a tapered hole 72 opening at the retainer surface 62*a* with a diameter smaller than the external diameter of the valve element 63 instead of the stepped hole 71. Adoption of the tapered hole 72 can attain the same effects as in the second embodiment.

Figure 5:
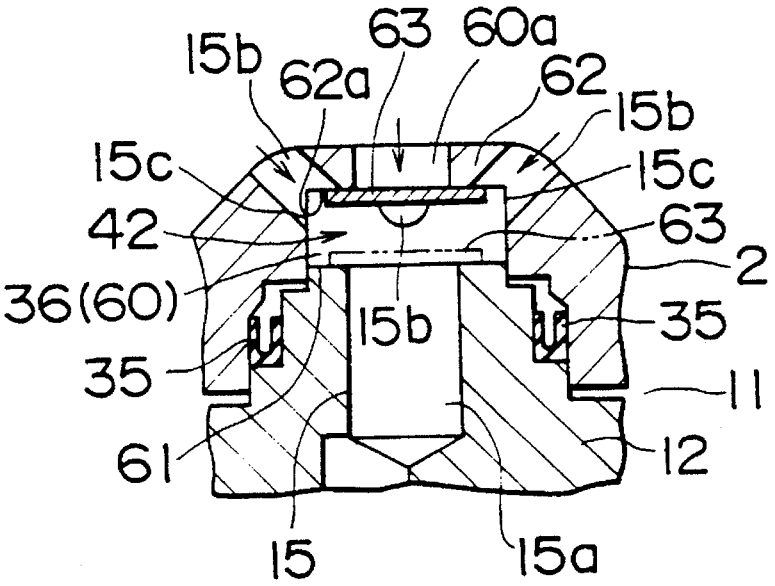
FIG. 5 is a view similar to FIG. 3 of a fourth embodiment of the present invention.

In the fourth embodiment shown in FIG. 5, an area of the valve element 63 on which the back pressure is exerted is increased. More particularly, in order to exert the back pressure on the valve element 63 from the discharge port 15*b* to separate the valve element 63 from the retainer surface 62*a*, an inlet 15*c* of the discharge port 15*b* opens at the retainer surface 62*a*.

With such a structure, in addition to the back pressure port 60*a*, the discharge port 15*b* also functions to exert the back pressure for separating the valve element 63 attached to the retainer surface 62*a*. Accordingly, the delayed closing of the check valve can be improved proportionally to the increased area on which the back pressure is exerted.

Figure 6:
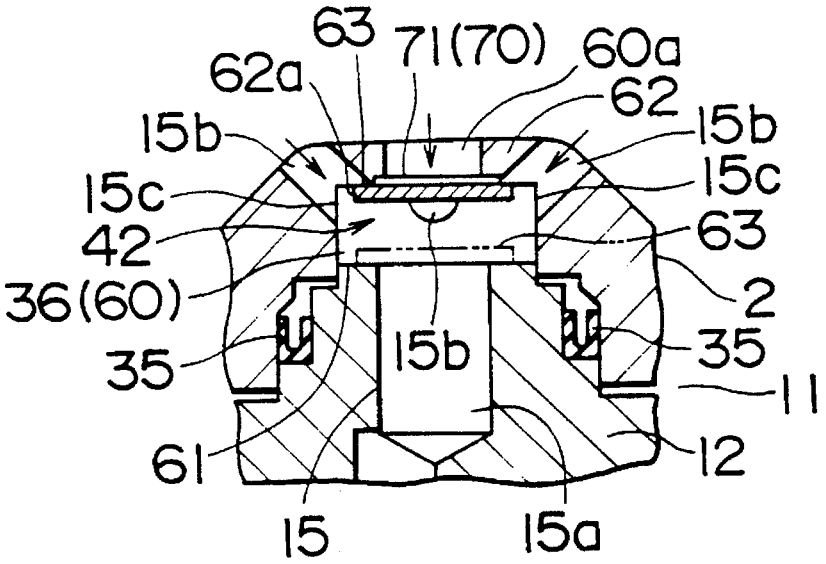
FIG. 6 is a view similar to FIG. 3 of a fifth embodiment of the present invention.

The fifth embodiment shown in FIG. 6 is a modification of the fourth embodiment. In the fifth embodiment, the structure that the inlet of the downstream discharge port 15*b* opens at the retainer surface 62*a* is applied to the check valve 42 having the stepped hole 71 described in the second embodiment.

Figure 7:
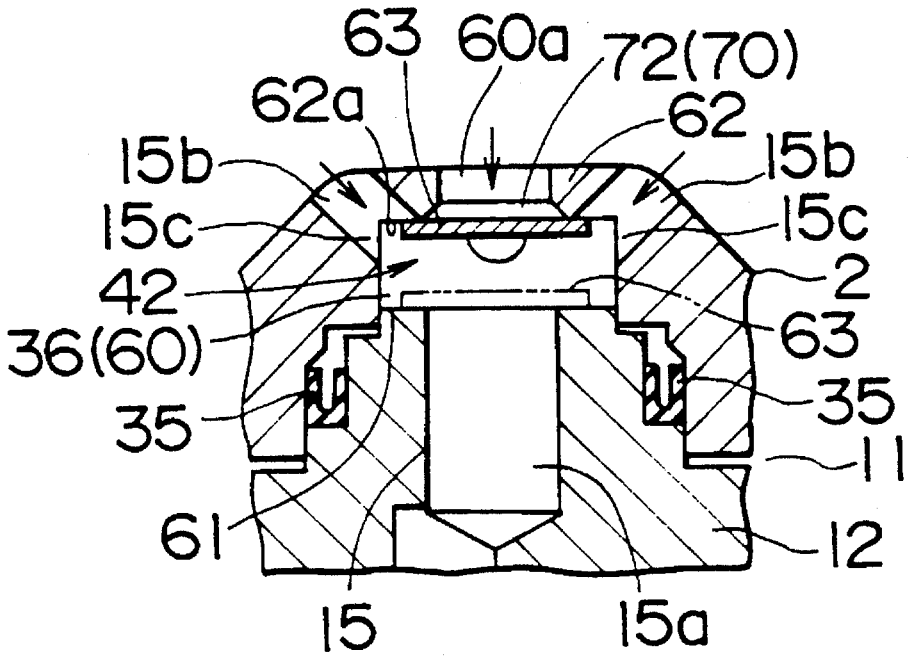
FIG. 7 is a view similar to FIG. 3 of a sixth embodiment of the present invention.
Figure 8:
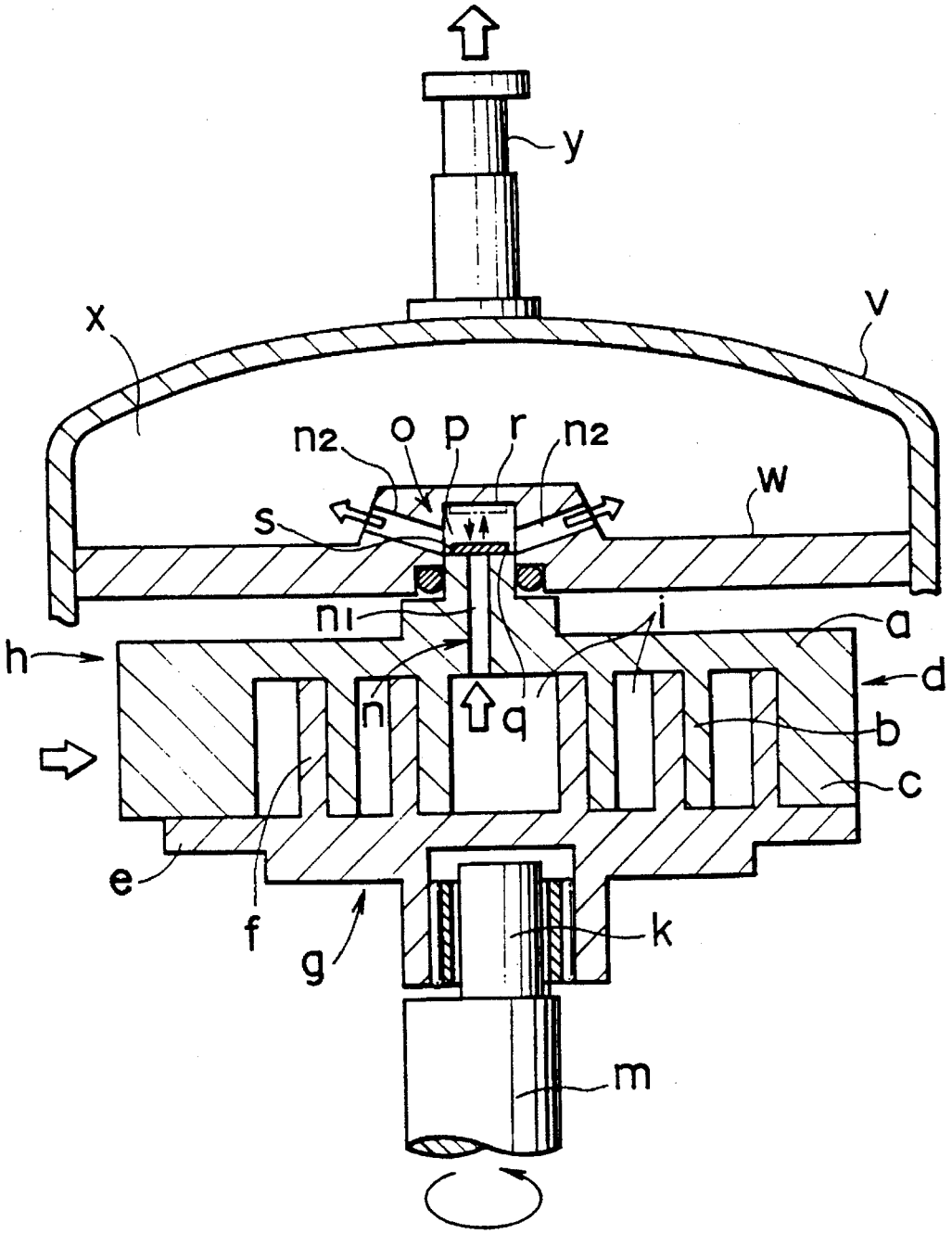
FIG. 8 PRIOR ART
FIG. 8 is schematic cross-sectional view of a conventional scroll type compressor including a free type check valve for prevention of backflow and for explaining operation of a valve element thereof.

The sixth embodiment shown in FIG. 7 is a modification of the fourth embodiment. In the sixth embodiment, the structure that the inlet of the downstream discharge port 15*b* opens at the retainer surface 62*a* is applied to the check valve 42 having the tapered hole 72 described in the third embodiment.

With the structure described above, the check valve 42 can attain the closing operation remarkably stably by increase of a pressure receiving area (back pressure receiving area) in addition to reduction of the contact area.

The claim:

1. A scroll type compressor including a housing having a high-pressure side chamber, a low-pressure side chamber, a discharge chamber, a scroll type compression mechanism having spiral wraps engaging each other disposed in said low-pressure side chamber for compressing gas by relative displacement of said wraps, a discharge port communicating said compression mechanism with said high-pressure side chamber, a valve chamber disposed in said discharge port, a valve seat formed at an edge of an opening on the side of said valve chamber between said valve chamber and said discharge port, a retainer means between said discharge chamber and said valve chamber opposite to said valve seat, and a valve element in said valve chamber and movable between said valve seat in a closed position and said retainer means in an open position, said valve element abutting against said retainer means in said open position when said compression mechanism is operated, said valve element abutting against said valve seat to close said discharge port when said compression mechanism is stopped, comprising:

a back pressure port disposed in said retainer means and having one end communicating with said valve chamber and the other end communicating with said discharge chamber; and a retainer surface on said retainer means at said one end of said back pressure port engageable by said valve element in said open position for closing said back pressure port when said compression mechanism is operated;

said back pressure port having a diameter satisfying the equation:

$$D_3<\{H+(D_1+D_2)/2\}^{1/2}$$

where $D_1$ is the diameter of said back pressure port, $D_2$ is the internal diameter of said valve chamber, $D_3$ is the outer diameter of said valve element, and H is the height of said valve chamber between said valve seat and said retainer surface.

2. A scroll type compressor as claimed in claim 1, wherein said discharge port further comprises:

a downstream discharge port communicating said valve chamber with said discharge chamber; and an inlet for said downstream discharge port opening at said retainer surface.

3. A scroll type compressor as claimed in claim 1, and further comprising;

a recess formed in said retainer surface and having an opening at said retainer surface smaller than said outer diameter of said valve element so that said valve element engages said retainer surface around said recess for closing said back pressure port in said open position.

4. The scroll type compressor as claimed in claim 3, wherein:

said recess comprises a stepped hole substantially concentric with said back pressure port and having a diameter smaller than said outer diameter of said valve element.

5. The scroll type compressor as claimed in claim 3, wherein:

said recess comprises a tapered hole substantially concentric with said back pressure port and having a diameter at said opening at said retainer surface smaller than said outer diameter of said valve element.

6. A scroll type compressor as claimed in claim 3, wherein said discharge port further comprises:

a downstream discharge port communicating said valve chamber with said discharge chamber; and an inlet for said downstream discharge port opening at said retainer surface.

7. In a scroll-type fluid machine, including a housing having a high pressure side chamber, a low pressure side chamber and a discharge chamber, an axially displaceable fixed scroll having an end plate, a spiral wrap on said end plate, a peripheral wall surrounding said spiral wrap, an axial end surface on said end plate, an orbiting scroll having a central axis and an end plate, a spiral wrap on said end plate of said orbiting scroll engaging with said spiral wrap on said fixed scroll, one of said scrolls being axially pressed against the other of said scrolls, and an axial end surface on said end plate of said orbiting scroll and having a peripheral portion, said scrolls comprising a compression mechanism having an outlet, the improvement comprising:

a first substantially cylindrical inner flange protruding from said axial end surface on said end plate of said fixed scroll and having a central axis aligned with said central axis of said orbiting scroll;

an outer substantially cylindrical flange extending from said axial end surface on said end plate of said fixed scroll radially outwardly of and in concentric spaced relationship with respect to said inner flange;

a discharge cover having a substantially circumferential intermediate flange concentric with and protruding between said inner and outer flanges;

facing surfaces on said inner and outer flanges and inner and outer facing surfaces on said intermediate flange, said facing surfaces on said inner and outer flanges facing said inner and outer facing surfaces on said intermediate flange, respectively;

surfaces on said intermediate flange engaging said facing services on said inner and outer flanges;

a valve chamber between said discharge cover, said inner flange and said intermediate flange and disposed centrally with respect to said flanges;

seal means between and in engaging sealing relationship with said facing surface on said inner flange and said inner facing surface on said intermediate flange for sealing said low pressure side chamber from said high-pressure side chamber;

a discharge port in said fixed scroll communicating said compression mechanism with said valve chamber;

a valve seat formed at an edge of an opening on the side of said valve chamber between said valve chamber and said discharge port;

retainer means on said discharge cover between said discharge chamber and said valve chamber opposite said valve seat;

a valve element in said valve chamber movably disposed between said valve seat in a closed position and said retainer means in an open position, said valve element engaging in abutting relationship against said retainer means in said open position when said compression mechanism is operated and engaging in abutting relationship against said valve seat to close said discharge port in said closed position when said compression mechanism is stopped;

a back pressure port in said retainer means having one end communicating with said valve chamber and the other end communicating with said discharge chamber; and a retainer surface on said retainer means at said one end of said back pressure port engageable by said valve element in said open position for closing said back pressure port when said compression mechanism is operated;

said back pressure port having a diameter satisfying the equation:

$$D_3<\{H+(D_1+D_2)/2\}^{1/2}$$

where $D_1$ is the diameter of said back pressure port, $D_2$ is the internal diameter of said valve chamber, $D_3$ is the outer diameter of said valve element, and H is the height of said valve chamber between said valve seat and said retainer surface.

* * * * *